United States Patent [19]

Kirkland

[11] Patent Number: 5,007,346

[45] Date of Patent: Apr. 16, 1991

[54] DEVICE FOR DETECTING AND/OR SWEEPING ELECTRICALLY CONTROLLED MINES

[75] Inventor: James L. Kirkland, Panama City, Fla.

[73] Assignee: United States of America as Represented by the Secretary of the Navy, Washington, D.C.

[21] Appl. No.: 675,277

[22] Filed: Oct. 11, 1967

[51] Int. Cl.[5] ..... B63G 9/00; F42B 22/42

[52] U.S. Cl. ..... 102/402; 89/1.11; 89/1.13; 114/221 A

[58] Field of Search ..... 114/221, 221.1, 235, 114/235.2; 89/1.01, 1 A, 1 M; 340/3 T

[56] References Cited

U.S. PATENT DOCUMENTS 2,967,506 1/1961 Livermore ..... 89/1.11

*Primary Examiner*—David H. Brown

*Attorney, Agent, or Firm*—Harvey David; John Becker; Sol Sheinbein

[57] ABSTRACT

A device for detecting and/or sweeping electrically controlled mines, which device will provide an indication of the presence of a control cable connected to the mine, and will serve as a countermeasure for such mines, by selectively detonating same after cutting of its control line after the sweeping vessel is beyond the mine's effective range. The circuitry of the device includes a high D.C. voltage source connected with a capacitor so as to charge the capacitor through a protective current limiting resistor, whereby the voltage is caused to discharge through the control cable so as to indicate the presence of the mine. An insulated blade type grapple knife system, to prevent inadvertent shorting of the detonating circuit, is used in conjunction with a sensitivity adjustable magnetometer and a switch to provide the desired safety range to permit the cutter to sever the mine's control cable without endangering the tow vessel or its personnel.

10 Claims, 1 Drawing Sheet

DEVICE FOR DETECTING AND/OR SWEEPING ELECTRICALLY CONTROLLED MINES

This invention relates to the detection of a concealed electrical wire as well as means to transmit a high voltage pulse to said concealed wire. More particularly the invention pertains to the detection of control cables of electrically detonated mines and the sweeping of said mines by electrical means.

The navigable watercourses and harbors of occupied territory are frequently mined by a type of mine which is electrically detonated from shore by a manually initiated control signal via a concealed control cable. Such mines are moored by an anchor and float submerged in the channel traverse by friendly ships. These mines are made, for the most part, of locally available materials the control cables are frequently made of telephone wire, lamp cord, or the like. The detonator circuit for the mine is, generally, a low voltage circuit responsive to available battery or hand generator type of fire box controllers of known types. Such a circuit is not affected by slight water leakage or joint weaknesses that naturally exist in such an installation and the mine is an effective weapon despite their hasty and oft times imperfect construction. Such mines are known: as Riverine mines. A countermeasure for such mines has consisted of towing a cutting or abrasive weight along the bottom of the waterway to sever the control cable.

The simple severing of the control cable, while disabling the mine, has several limitations as a complete countermeasure technique. There is no indication of the presence of the control cables to indicate the location of the mine field. The mine per se remains undetonated and reconnection is likely. Attempts to indicate the presence of severed control cables in the past have involved the use of mechanical sensors and tension responsive devices in the tow line. Such attempts to provide an indication of control cables have proved unsatisfactory in use because of false indications occasioned by the fouling of the cutter on the bottom of the waterway.

Previous attempts to detonate Riverine mines electrically have employed a towed electrically charged cutter which serves to activate the detonator upon contact with the mine control cable. Such attempts have proven unsatisfactory in use for a variety of reasons, principally due to electrical short circuits and insulation breakdown.

It is, therefore, an object of this invention to provide a device which will provide an indication of the presence of a control cable for a Riverine mine, as well as serve as a countermeasure for such mines while overcoming the aforementioned deficiencies of the prior art.

More particularly it is an object of this invention to provide an indication of the presence of a control cable of a Riverine mine which is not affected by variation in tow line tension.

It is a further object of this invention to provide an effective countermeasure for a Riverine mine which will detonate the mine as well as sever the control cable.

It is a further object of this invention to provide an effective countermeasure which incorporates a safety feature providing the selective detonation of only those Riverine mines which are beyond their e range from the minesweeping vehicle.

It is a further object of this invention to provide an electrically activated Riverine mine countermeasure device incorporating an improved control cable severing instrumentality that is immune from short circuiting occasioned by deformation arising from contact with submerged solid objects.

Other objects and many of the attendant advantages will be readily appreciated as the subject invention becomes better understood by reference to the following detailed description, when considered in conjunction with the accompanying drawings wherein.

Figure 1:
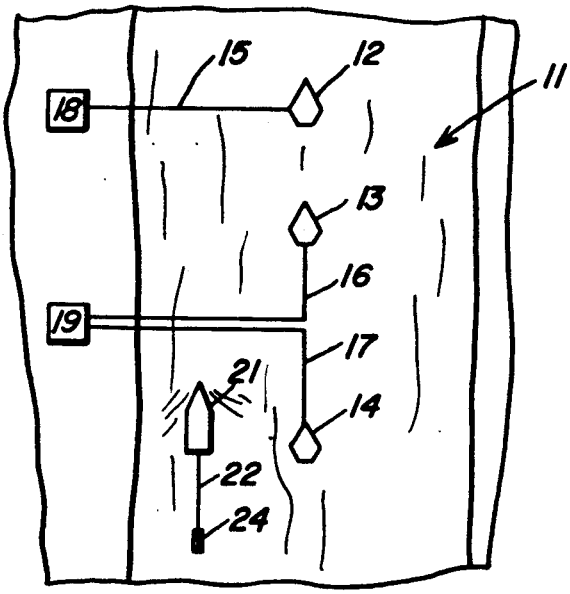
FIG. 1 illustrates a hypothetical environment where the device is to be used.

Referring to FIG. 1, which shows a river 11 having Riverine mines 12, 13, and 14, disposed in the center thereof, connected, respectively, by control cables 15, 16, and 17 to shore positions 18 and 19. A tractor vehicle 21 tows a towline 22. In addition to transmitting a towing force tow line 22 contains two insulated conductors 23 (see FIG. 2) and provision for towing a cutter 24. For purposes of explanation, it will be assumed that the tow vehicle is a shallow draft vessel, however, it should be understood that a land vehicle or an aircraft, either fixed or rotary wing, could be employed as a tow vehicle if desired.

Figure 2:
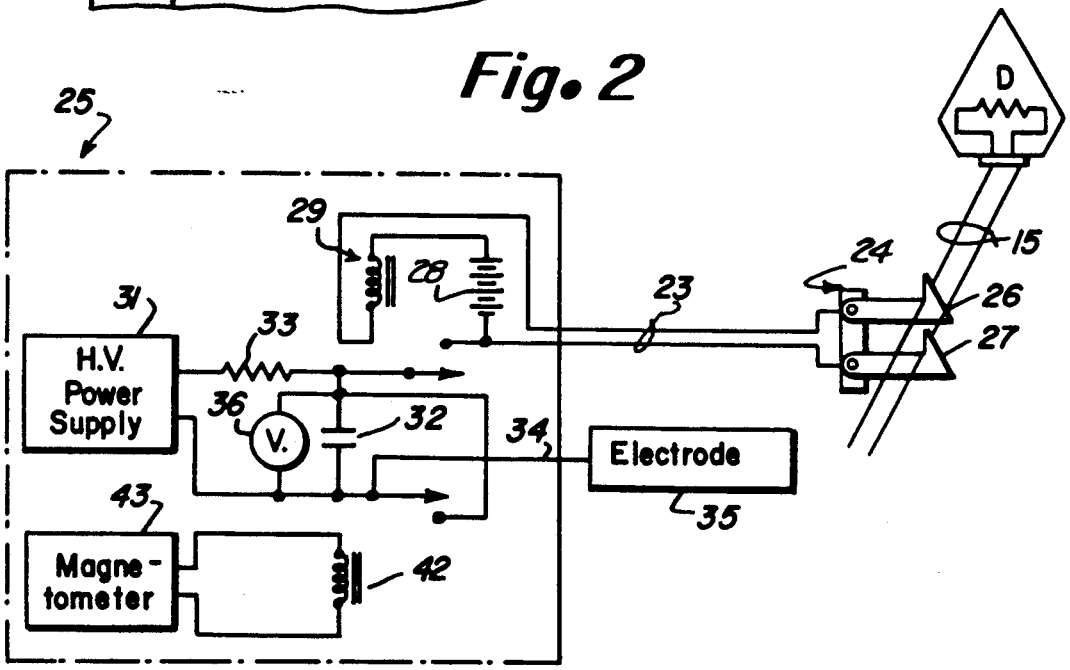
FIG. 2 illustrates a circuit arrangement useful in the invention.

Referring to FIG. 2, it will be seen that the conductors 23 connect the cutter 24 with circuitry 25 carried by the tractor vessel 21. Cutter 24 Includes a pair of conducting blades 26 and 27 adapted to penetrate the insulation of a Riverine mine control cable 15 to expose the conductors of cable 15 to the water and establish a conducting path between the blades. Circuitry 25 includes a source of low potential 28 and an electrically operated switch 29 connected in such a fashion that the placement of a conductor across cutter blades 26 and 27 causes operation of switch 29. For purposes of illustration, switch 29 is shown as an electro-mechanical relay, but it will be readily understood that other known electrically activated switches may be employed including hard vacuum tubes, gas filled thyatrons, and known solid state equivalents.

Circuitry 25 further includes a source of high voltage DC current shown diagrammatically at 31. High voltage source 31 is connected in circuit with a capacitor 32 so as to charge the capacitor 32 through a current limiting resistor 33, which protects the high voltage power source. One terminal of capacitor 32 is also connected through switch 29 to the tow line conductor 23, and the other terminal is connected by a conducting cable 34 to a high voltage return electrode 35, submerged in the water. Electrode 35 may take several forms, an electrode with an area of four square feet affixed to the tow vessel in such manner as to be submerged in the water is contemplated but other forms, including simply a length of insulated wire with 10 feet of insulation removed, have proved effective. The charge on capacitor 32 is monitored by a suitable instrument illustratively diagrammed as voltmeter 36.

Figure 3:
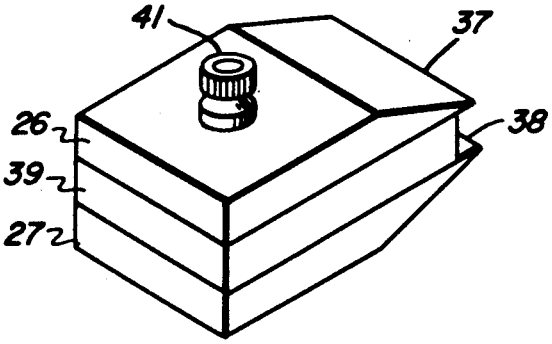
FIG. 3 illustrates a preferred cutter construction used in the device of the invention.

In operation the contact of a conductor by cutter 24, occasioned by the impact of cutter 24 and a Riverine mine control cable 15, causes switch 29 to connect capacitor 32 to one of the tow cable conductor 23, which causes a high voltage pulse to travel cable conductors 23 to control cable 15 and to return via water conduction to electrode 35. In order to assure simultaneous contact with a conductor in cable 15 the two cutter blades must be placed physically close together. This placement is susceptible to blades shorting upon impact with solids submerged in the water. A satisfactory solution to this problem is the cutter construction shown in FIG. 3 where it can be seen that blades 26 and 27 with sharpened edges 37 and 38 spaced in close proximity by an insulating spacer 39. Suitable provision is made for electrically securing each blade to an electrical conductor shown illustratively as a thumb screw 41. It will be noted that insulating spacer 39 is coextensive with blades 26 and 27 except for their extreme edge portions 37 and 38. Such construction permits blades 26 and 27 to make individual penetration into an insulating sheath of a conductor, as well as permitting the blade pair to function as a single blade. An additional advantage of this construction is that blade shorting by small conductive pieces of debris collecting between the cutter blades is prevented. It will be appreciated that in practice cutter 24 includes a plurality of blade pairs and is constructed to remain below the water when towed by a suitable tractor vehicle.

As can be seen from a study of FIG. 1, mines can be placed in the narrow channel of a river such that their detonation cause damaging effects to the tractor vehicle. To avoid this, a safety control circuit may be incorporated in the high voltage source by connecting a switch 42 to discharge capacitor 32 in response to a signal by a magnetometer 43. A typical Riverine mine ranges in magnetic moment from 3000 to 5000 pole-cm and such a moment is detectable from a range of 15 to 20 feet by a total field magnetometer of a known type. Selection of a switch with a suitable time response together with suitable adjustment of the sensitivity of the magnetometer 43 will provide a safety range to permit the cutter to break control cables 16 and 17 without endangering the tow vehicle or its operational personnel. Such a constructional and operational modification to meet varying operational parameters, is considered to be well within the purview of the skilled artisan. As in the case of switch 29, other electro-responsive switches may be employed for switch 42 than the electro-mechanical switch shown if deemed desirable.

The circuit operation of the detecting device is understood by considering cutter 24 as towed across a control cable 15 in such a manner the insulation of the cable is penetrated by impact of cutter 24 upon cable 15. The penetration of the insulation permits the cutters to simultaneously contact a single conductor or otherwise establish a conducting path between them through the control circuitry of the mine. The establishment of this conductive path causes the operation of switch device 29 connecting capacitor 32 with its stored electrical charge to tow cable conductors 23. The capacitor 32 discharges through conductors 15, cutter 24, water conduction path to electrode 35, and cable 34. An indicator 36 responsive to the electrical charge on capacitor 32 indicates that cutter 24 has contacted a conductor by showing a variation in the charge of capacitor 32, If a detectable mine is near the tow vehicle magnetometer 43 closes electrical switch 42 which discharges caPacitor 32 directly through the contact portion of switch 42, thereby preventing detonation of the nearby mine. Switch 42 may be connected as to open the discharge path by connection in series with switch 29 or by placement in conducting cable 34 if such operation is desired rather than discharging capacitor 32.

Figure 4:
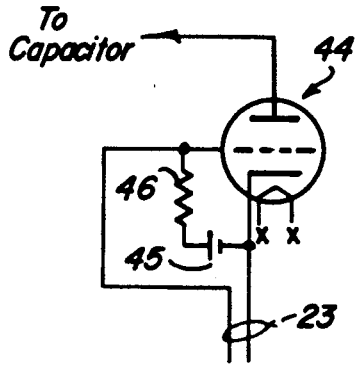
FIG. 4 illustrates an alternate circuit construction.

In place of switch 29 a vacuum tube equivalent may be employed as shown in FIG. 4. Vacuum tube 44 is held below the cut off point by a suitable bias from biasing voltage source 45 through resistor 46. When the cutter blades contact a conductor, tube 44 becomes conductive, connecting the capacitor 32 to the tow line conductors 23. This vacuum tube circuit is only illustrative and any of the known vacuum tube circuits may be employed including those using thyatrons. It is understood that in a similar manner switch 42 may be replaced by a vacuum tube circuit if desired.

The indicator 36 may be of any suitable type, and while shown as monitoring the charge of capacitor 32, it could monitor the operation of switch 29 directly. Such an operative connection may be desirable when the magnetometer safety circuit is employed and an indication of cutter-cable contacts is desired.

The precise manner in which the device sweeps the Riverine mines and in particular the exact manner in which the high voltage pulse detonates the mine can not be accurately predicted because of the variations in installation hardware and techniques and manner in which cutter 24 intercepts the mine control cable. However, consideration of some of the observed cases will serve to clarify some modes of operation. When the control cable is connected to some detonating control mechanism at the shore control point and both blades of the cutter contact both control wires, the charge on capacitor 32 is divided with a part thereof going to the controller and a part thereof going to the detonator in the mine. The return path in such a case may be through electrical leakage in the mine between the detonator circuit and the mine case and a water return path, or through a leakage at the point of entry of the control cable into the mine. The latter case has been observed many times as a corona or arc. If one wire of a controller connected mine is penetrated before the other, then the current path is through the detonator, the other wire, the controller, the penetrated wire and via the water return. If the control cable is unconnected at the shore installation, the return path is via detonator-mine leakage or control cable joint leakage, as outlined in the connected cable example above. In one successful embodiment, the device employs a high voltage of 16,000 volts: and the value of capacitor 32 is 80 microfarads. The effects of a pulse of this magnitude being delivered to a low voltage detonator circuit are so catastrophic to the system that the actual current path is difficult to determine.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

The invention described herein may be manufactured and used by or for the Government of the United States of America for governmental purposes without the payment of any royalties thereon or therefor.

What is claimed is:

1. Means for detecting an insulated electrical conductor located within a subaqueous medium, comprising:

means submerged within said subaqueous medium for penetrating the insulation of and making electrical contact with said electrical conductor upon impact therewith;

a source of high potential electrical energy;

an electrode means connected to said source of high potential energy disposed within the aforesaid subaqueous medium in such manner as to make electrical connection therewith;

means connected to said insulated electrical conductor contacting means and to said electrode means for timely and effectively connecting said high potential electrical source to the electrical conductor of said insulated electrical conductor in response to the impact of said electrical conductor contacting means thereon; and means connected across said high potential electrical energy source and responsive to variations in said high potential electrical energy source for indicating the connection of said high potential electrical source to the aforesaid insulated electrical conductor.

2. The device of claim 1 wherein said source of high potential electrical energy includes a charged capacitor.

3. The device of claim 1 wherein said penetrating means includes two sharpened planiform blades separated by an insulating solid material.

4. The device of claim 1 wherein said means responsive to the impact of said electrical conductor and said electrical conductor contacting means includes a vacuum tube.

5. The device of claim 1 wherein said source of high potential electrical energy includes control means to prevent the transmission of electrical .energy from said source to said penetrating means when said source is connected to said insulated electrical conductor contacting means.

6. The device of claim 5 wherein said control means is responsive to the proximity of metal bodies to said device.

7. The device of claim 5 wherein said source of high potential electrical energy includes a charged capacitor.

8. The device of claim 7 wherein said control means includes a switch circuit to discharge said capacitor.

9. The device of claim 8 wherein said penetrating means includes two sharpened planiform blades separated by an insulating solid material.

10. The device of claim 9 wherein said means responsive to the impact of said electrical conductor and said electrical conductor contacting means includes a vacuum tube.

* * * * *